US005805406A

United States Patent [19]

Mailand

[11] Patent Number: 5,805,406

[45] Date of Patent: Sep. 8, 1998

[54] DEVICE FOR TREATING HAIR

[76] Inventor: Kirsten Herløv Mailand, Bakkegardsvej 311, Humlebæk, Denmark, 3050

[21] Appl. No.: 776,103

[22] PCT Filed: Jul. 20, 1995

[86] PCT No.: PCT/DK95/00313

§ 371 Date: Jan. 21, 1997

§ 102(e) Date: Jan. 21, 1997

[87] PCT Pub. No.: WO96/03062

PCT Pub. Date: Feb. 8, 1996

[30] Foreign Application Priority Data

Jul. 21, 1994 [DK] Denmark ..... 0867/94

[51] Int. Cl.[6] ..... H05F 3/06

[52] U.S. Cl. ..... 361/212; 361/213; 392/380; 392/385

[58] Field of Search ..... 361/212, 213, 361/220, 221, 224, 235; 392/379–385

[56] References Cited

U.S. PATENT DOCUMENTS

| | | | |
|---|---|---|---|
| 4,258,408 | 3/1981 | Cantelli | 361/213 |
| 4,333,123 | 6/1982 | Moulden | 361/213 |
| 4,498,116 | 2/1985 | Saurenman | 361/213 |
| 4,689,715 | 8/1987 | Halleck | 361/213 |
| 4,729,057 | 3/1988 | Halleck | 361/213 |
| 5,055,963 | 10/1991 | Partridge | 361/213 |
| 5,612,849 | 3/1997 | Prehodka et al. | 361/213 |

FOREIGN PATENT DOCUMENTS

| | | |
|---|---|---|
| 2 055 573 | 3/1981 | United Kingdom . |
| 2067071 | 7/1981 | United Kingdom . |

*Primary Examiner*—Fritz Fleming

*Attorney, Agent, or Firm*—Jacobson, Price, Holman & Stern, PLLC

[57] ABSTRACT

A device for treating hair comprises an electrically driven blower for generating an air flow at at least one opening on the device with view to drying the hair, as well as a unit for emitting ions from one or more emitters positioned in or close to the opening of the device. The unit for emitting ions has at least two emitters which are adapted to emit ions of positive charge and of negative charge, respectively, at the same time.

10 Claims, 3 Drawing Sheets

DEVICE FOR TREATING HAIR

Figure 2:
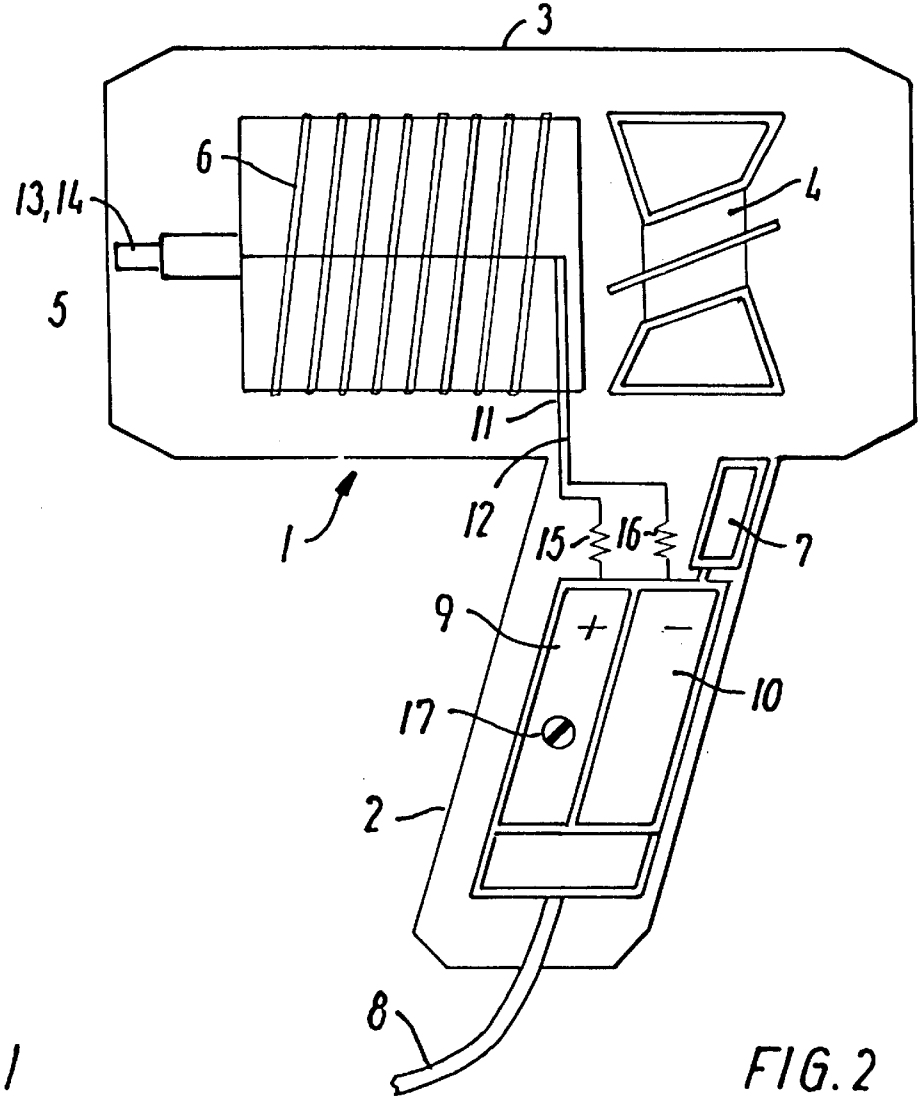

The invention concerns a device for treating hair. The device comprises an electrically driven blower for generating a flow of air at at least one opening on the device with a view to drying said hair, as well as a unit for emitting ions from one or more emitters positioned in or close to said opening of the device.

It is well-known that many bodies can be charged electro-statically, and that electrically insulated objects can keep this charge for a long period of time. Since hair is electrically insulating, it may thus be charged with static electricity when treated e.g. with brushes, combs, towels or garments, and this static electricitry may subsequently be difficult to remove. This static electricity can make the hair stand on end, just as it becomes stiff and difficult to do as desired. Furthermore, the static electricity in the hair causes it to attract dust and therefore to become dirty more quickly. The problem occurs in particular when the hair, following washing, is dried by means of a hair dryer or the like which blows hot air against the hair, perhaps while it is being brushed.

It has previously been attempted to solve this problem by combining an electric hair dryer with a form of ion generator capable of emitting ions towards the hair, while the hair is being dried by means of the air flow from the hair dryer. If the emitted ions are of a polarity opposite to the one with which the hair is charged, the emitted ions neutralize the electrostatic charges in the hair if they are supplied to a sufficient extent. For example, British Patent Application 2 023 351 describes a device using a piezoelectric transducer for generating ions which can be sent towards the hair. However, it takes a relatively complicated mechanical device to operate such a piezoelectric transducer, and the transducers can lose their mechanical properties after some time, so that the piezoelectric effect ceases.

It is attempted to obviate these problems in British Patent Application GB 2 067 071 by using an ion generator which continuously emits a flow of ions of fixed polarity. This means that electric charges which may serve to neutralize the electrostatic charging of the hair, are actually transferred to the hair. However, the principle works only if the emitted ions are of a polarity opposite to that of the hair. Accordingly, it is necessary to know beforehand with which polarity the hair is charged, and this is not possible in practice, since it has been found that the polarity of the charges on the hair depends upon how the charging has occured. If e.g. a comb has been used for the hair, the polarity may depend upon the material of which the comb is made. If this polarity is not known in advance, this device thus involves the risk of emitting ions of the same polarity as the hair, which merely intensifies the charging of the hair which has already taken place.

Even if the right polarity of the emitted ions might perhaps have been selected, tests have shown that the problem is nevertheless not solved satisfactorily. If the hair is charged e.g. with negative charges, and positive ions are emitted from the ion generator in the hair dryer, the desired effect is achieved initially, since the emitted positive ions serve to neutralize some of the electric charges of the hair. This means that the electro-static charge of the hair moves toward zero, as desired. If, however, positive ions continue to be emitted after the charge of the hair has reached zero, the hair will now be charged with positive ions so that precisely the same problem as before the treatment was initiated, will arise after some time. The only difference is just that the hair is charged positively instead of negatively.

Thus, this device gives the desired effect only if it is indicated when the electrostatic charge of the hair passes zero, and this is not possible in practice.

The object of the invention is to provide a device of the type described in the opening paragraph, capable of ensuring that the charge of the hair is essentially completely neutralized, no matter whether the treatment is continued after this state has been reached, and independent of the polarity with which the hair has originally been charged.

This is achieved according to the invention in that the device has at least two ion emitters for simultaneous emission of positive ions and negative ions, respectively. The static charge of the hair attracts ions of opposite sign, thereby neutralizing the charge of the hair.

It is ensured in a special embodiment of the invention that nothing more happens when the hair has been discharged, since, although the flow of air contains many ions, it contains equal amounts of each type and is therefore neutral as a whole.

In another embodiment of the device of the invention the refor ions are generated in that a positive DC voltage and a negative DC voltage, respectively, supplied from their respective voltage generators, are applied to the emitters. Since a given emitter requires less voltage to produce negative ions than positive ones, e.g. a voltage of 1600–1700 volts is applied to the negative emitter, while the positive voltage may then be 2100–2200 volts.

This is achieved in a expedient embodiment in that at least one of said voltages can be adjusted with a view to achieving said balance. In the manufacture of the device it is thus possible to adjust one or both voltages, while the resulting electrostatic charge is measured on a body suitably spaced from the device, so as to adjust for optimum effect.

In two alternative embodiments, the emitters, may be constructed either as metal needles or as carbon brushes. It is expedient to insert safety resistors in the wires to the emitters so that these will be safe to touch.

Figure 3:
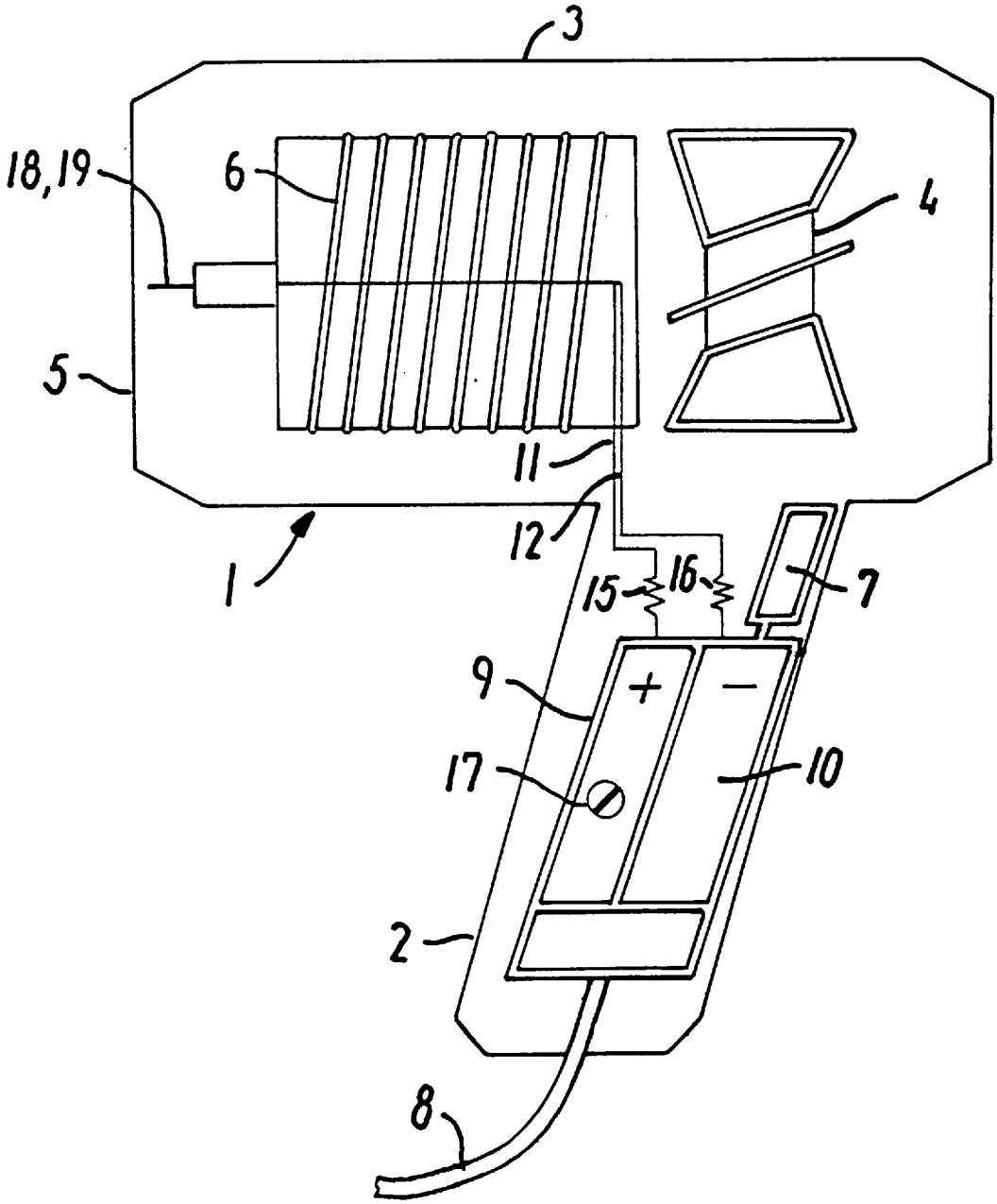
Figure 4:
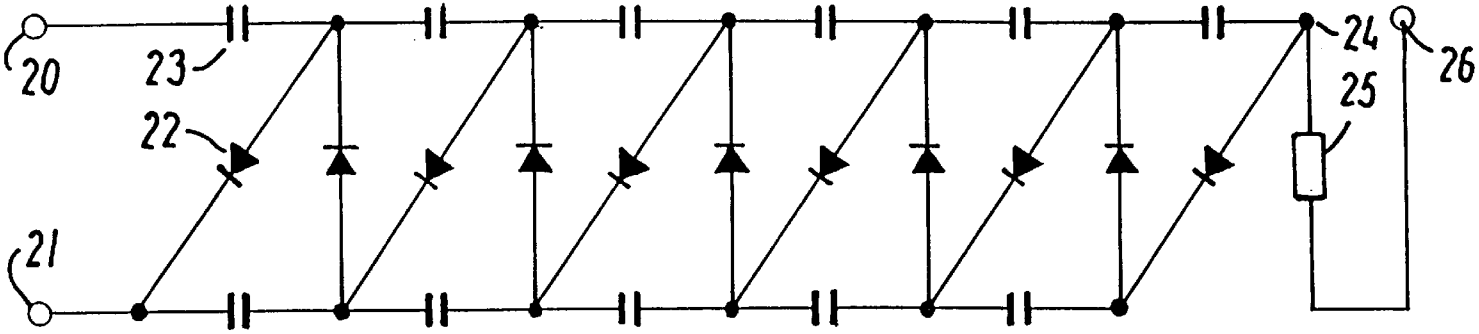
Figure 5:
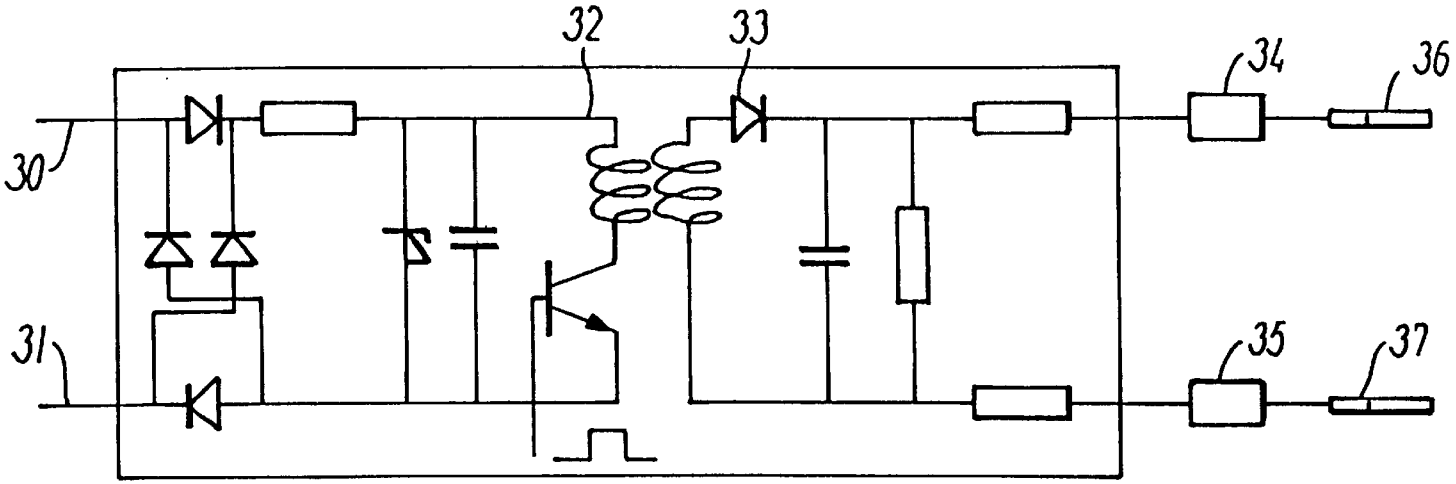

Tests have shown that the two emitters, should be placed at a mutual distance of at least 12 mm, and a particularly advantageous effect is obtained if the emitters, are placed at a mutual distance of about 50 mm. Furthermore, the emitters should be so placed with respect to the air flow from the blower of the hair dryer that this air flow moves transversly to the electrostatic field which occurs between the emitters. The invention will be explained more fully below with reference to the drawing, in which FIG. 1 is a front view of the device of the invention, FIG. 2 is a lateral sectional view of the device of FIG. 1, FIG. 3 is a lateral sectional view of an alternative embodiment of the device of the invention, FIG. 4 shows the electric diagram for the construction of an ion generator, and FIG. 5 shows an alternative structure of the circuit for an ion generator.

Figure 1:
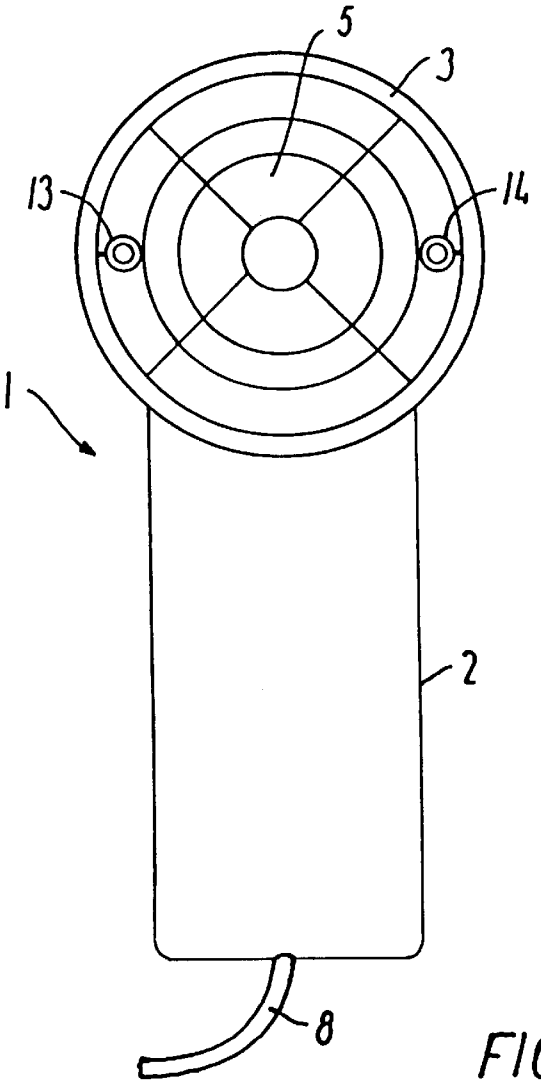

FIGS. 1 and 2 show a first embodiment of a device, i.e. a hair dryer according to the invention. FIG. 1 is a front view of the device, while FIG. 2 is a sectional drawing showing the device from the side. The device is designated 1. The housing of the device is divided into two parts, viz. a handle part 2 and blower and mouth part 3. The blower and mouth part 3 accommodates the well-known elements of a hair dryer. These are a blower 4 capable of providing the desired air flow which leaves the hair dryer through the mouth 5, and a heating element 6 capable of heating the air flow before it leaves the blower through the mouth 5. The blower 4 and the heating element 6 are turned on and off by means of a switch 7, which may expediently be arranged on the handle 2. The device is supplied with power from the mains via a lead 8, which is likewise connected to the handle 2.

The handle 2 moreover accommodates two voltage generators, viz. a positive voltage generator 9 and a negative voltage generator 10. These voltage generators can generate high DC voltages, e.g. of the order of 1.5 to 2 kvolts, of positive polarity and negative polarity, respectively. The high voltages from the voltage generators 9 and 10 are conveyed via wires 11 and 12 to the two carbon brushes 13 and 14, from which ions of positive polarity and of negative polarity, respectively, are then emitted and conveyed by an air flow produced by the blower 4. It is noted that the two carbon brushes 13 and 14 are arranged close to the mouth 5 where the air flow leaves the hair dryer. For reasons of safety, two safety resistors 15 and 16 are provided in the two wires 11 and 12, ensuring that the two carbon brushes 13 and 14 can be touched safely, even when the two high voltage generators 9 and 10 are turned on. The two wires 11 and 12 to the carbon brushes 13 and 14 are run in such a manner from the two voltage generators 9 and 10 to the carbon brushes 13 and 14 that they are not damaged by the heating element 6.

Also the two voltage generators 9 and 10, and thus the emitters 13 and 14, are turned on and off by means of a switch 7. This switch may be adapted to turn on the ion generators, while turning on the blower 4 and the heating element 6. Thus, in this case, ions will always be emitted when the hair dryer is used. Alternatively, the switch 7 may be constructed such that the ion generators can be turned on and off independently of the blower 4 and the heating element 6, so that the device may be used as a normal hair dryer without ion generators merely by smiting turning on the latter. The ion generators may then be turned on as needed. Of course, the switch 7 may also be constructed such that the blower 4 and the heating element 6 can be turned on independently of each other.

To obtain correct balancing of the ions emitted from the carbon brushes 13, 14 so that an insulating body, such as e.g. hair, which is placed in front of the mouth 5, will be discharged following operation of the ion generators, the two voltage generators must produce the same amount of ions per unit of time. This is achieved in that a suitably higher voltage is applied to the positive emitter than to the negative one, typically perhaps 30% higher. To achieve the perfect balance, it may be necessary that at least one of the voltages is adjustable. Therefore, the figure shows an adjusting screw 17 provided on the positive voltage generator 9. Thus, in the manufacture of the hair dryer the voltage applied by the voltage generator 9 to the positive carbon brash may be adjusted, while the hair dryer is directed toward a metering object and the adjusting screw is adjusted until the voltage of the metering object is close to 0 volt.

As appears from FIG. 2, the carbon brushes 13 and 14 are provided close to the mouth 5 so that the air flow generated by the blower 4 passes the carbon brushes 13 and 14 after having passed the heating element 6. It has been found that the optimum distance between the carbon brushes 13 and 14 is about 50 mm, and the distance should at least not be less than 12 mm if an optimum effect is desired. It is moreover noted that the carbon brushes are arranged such that the air flow is transverse to the electric field which occurs between the positive carbon brush and the negative carbon brush. This gives the best distribution of the positive ions and the negative ions in the air flow.

FIG. 3 shows an alternative embodiment of the device of the invention. Metal needles 18, 19 are used here instead of the carbon brushes 13, 14. Like carbon brushes, a metal needle provided with a very sharp point is suitable for emitting ions when a high voltage is applied to it. Otherwise, the embodiment in FIG. 3 closely corresponds to the embodiment shown in FIG. 2.

FIG. 4 shows an example of how a circuit capable of generating the high voltage from the voltage generators 9 and 10 may be designed. The AC voltage from the supply lead 8 is passed to the two input terminals 20 and 21. Then, the circuit consists of a chain of links in the form of diodes and capacitors 23. These links serve as voltage doublers in series so that a high voltage is generated on the terminal 24, e.g. in the voltage range from 1.5 to 4 kvolts. Depending upon the conducting direction of the diodes with respect to the junctions with the capacitors, this voltage may be positive or negative. The high voltage is conveyed via a safety resistor 25 to the emitter 26, which may be one of the carbon brushes 13, 14 or one of the needles 18, 19.

If this form of voltage generator is employed, two generators have to be used to obtain both the positive voltage and the negative voltage. FIG. 5 shows an alternative embodiment of a voltage generator which is capable of emitting positive voltage as well as negative voltage at the same time. The terminals 30 and 31 are connected to the supply lead, the terminal 30 being connected to 220 volts and the terminal 31 to 0 volt. The generator consists of a step-up unit 32 followed by a rectifier 33. The two voltages are conveyed from the output terminals via safety resisters 34, 35 to the emitters 36, 37. This type of generator has the advantage that it is so small physically that it can easily be mounted in the handle of a hair dryer.

The foregoing shows examples of how a device according to the invention may be constructed, and it will be appreciated that details may be modified in a number of ways within the scope of the invention. Thus the emitters may be constructed in other ways than the described carbon brushes and metal needles, and also the voltage generators 9, 10 may be built in other ways than the one shown in FIG. 4. Further, the principle can of course also be applied to other similar devices, such as e.g. hot air curling irons.

I claim:

1. A device for treating hair, comprising an electrically driven blower for generating an air flow at at least one opening on the device with a view to drying said hair, as well as a unit for emitting ions from one or more emitters positioned in or close to the said opening of the device in a path of said air flow, said unit for emitting ions having at least two emitters which are adapted to emit ions of positive charge and of negative charge, respectively, at the same time.

2. A device according to claim 1, wherein said ions of positive charge and negative charge, respectively, are balanced so that statically charged objects subjected to the air flow from the device are neutralized essentially completely.

3. A device according to claim 2, wherein said emission of ions is produced by applying a positive DC voltage and a negative DC voltage, respectively, to said emitters, and wherein it is adapted to produce said balancing of the positive and negative ions by applying to the emitter producing the negative ions a voltage which is lower than the voltage applied to the emitter for the positive ions.

4. A device according to claim 3, wherein it is adapted such that at least one of said voltages can be adjusted with a view to achieving said balance of the positive and negative ions.

5. A device according to claim 1, wherein said emitters are formed by metal needles.

6. A device according to claim 1, wherein said emitters are formed by carbon brushes.

7. A device according to claim 3, wherein said voltages are applied to the emitters via safety resistors, so that the emitters can be touched safely.

8. A device according to claim 1, wherein said emitters are arranged at a mutual distance which is greater than 12 mm.

9. A device according to claim 8, wherein said emitters are arranged at a mutual distance of about 50 mm.

10. A device according to claim 1, wherein said emitters are so positioned with respect to said air flow that the direction of movement of said air flow is transverse to the electric field generated between the emitters.

* * * * *